US005420562A

United States Patent [19]

Kaltenecker

[11] Patent Number: 5,420,562

[45] Date of Patent: May 30, 1995

[54] RESISTOR HAVING GEOMETRY FOR ENHANCING RADIO FREQUENCY PERFORMANCE

[75] Inventor: Robert S. Kaltenecker, Chandler, Ariz.

[73] Assignee: Motorola, Inc., Schaumburg, Ill.

[21] Appl. No.: 127,613

[22] Filed: Sep. 28, 1993

[51] Int. Cl.[6] ..... H01C 3/12

[52] U.S. Cl. ..... 338/293; 338/60; 338/61; 338/327

[58] Field of Search ..... 338/293, 329, 333, 327, 338/35, 60, 61, 308, 309; 427/101; 428/336

[56] References Cited

U.S. PATENT DOCUMENTS 2,609,688 9/1952 Larach ..... 338/35
3,473,146 10/1969 Mulligan ..... 338/293
3,890,703 6/1975 Frazee et al. ..... 338/35 X
4,414,274 11/1983 Hieber ..... 338/308 X

*Primary Examiner*—Marvin M. Lateef
*Attorney, Agent, or Firm*—Rennie William Dover

[57] ABSTRACT

A resistor having a novel physical geometry is provided. The physical geometry of the resistor minimizes the current paths through the resistor such that the reactance components of the resistor is minimized for radio frequency operation. The resistor is made from a resistive material such as chrome silicon oxide, nichrome. The physical geometry of the resistor layout reduces the physical area occupied by the resistor, and also results in lower sensitivity to a DC trimming procedure used in the manufacturing process.

23 Claims, 4 Drawing Sheets

100

200

RESISTOR HAVING GEOMETRY FOR ENHANCING RADIO FREQUENCY PERFORMANCE

BACKGROUND OF THE INVENTION

This invention relates, in general, to resistors and more particularly to resistors that enhance the performance of radio frequency (RF) amplifiers.

In RF operation the response characteristic of a resistor is determined by a resistive component and a reactance component wherein the reactance component is caused by, for example, parasitic inductance and capacitance occurring in the leads of the resistor. Moreover, at high frequency operation this reactance component of the resistor acts to reduce the effective operation of the RF amplifier.

In prior art resistors, as frequency is increased, for low resistance values, typically less than 20 ohms, the lateral dimension of the resistor becomes very long compared to the wavelength of the current flowing through it. Since the current flow is distributed throughout the resistor, some current paths through the resistor are very long, causing long time delays. This results in a substantial degradation of response in radio frequency operation.

Hence, there exists a need for a resistor that results in enhanced frequency response in radio frequency operation.

SUMMARY OF THE INVENTION

The present invention provides for the physical layout geometry of the resistor that effectively shortens the current paths through the resistor and allows for a more uniform current distribution in the resistor. The inductive and capacitive components of the resistors are reduced thereby enhancing the frequency response of the resistor to radio frequencies. The physical geometry of the resistor layout reduces the physical area occupied by the resistor, and also results in lower sensitivity to a DC trimming procedure used in the manufacturing process.

DETAILED DESCRIPTION OF THE DRAWINGS

Generally, the present invention provides a method and apparatus for producing a resistor that has enhanced frequency response. This can be understood by analyzing the behavior of the electromagnetic fields in a given resistor geometry. At frequencies where the maximum dimensions of the resistor are small compared to a wavelength, a lumped element or circuit approach is appropriate. Current paths are by definition very short (no time delay). With increasing frequency this approach is no longer valid. A distributed circuit, one having dimensions comparable to a wavelength, has its resistive, inductive and capacitive properties distributed in a region. The current flow is distributed in a region and is dependent upon the physical structure of the region. The present invention effectively shortens the current path lengths in the distributed region and allows for a more uniform current distribution within the resistor region. These effects tend to minimize the associated parasitics (reactive components) of the resistor thus improving the high frequency behavior of the resistor. That is, the resistor still looks predominately resistive with increasing frequency.

Figure 1:
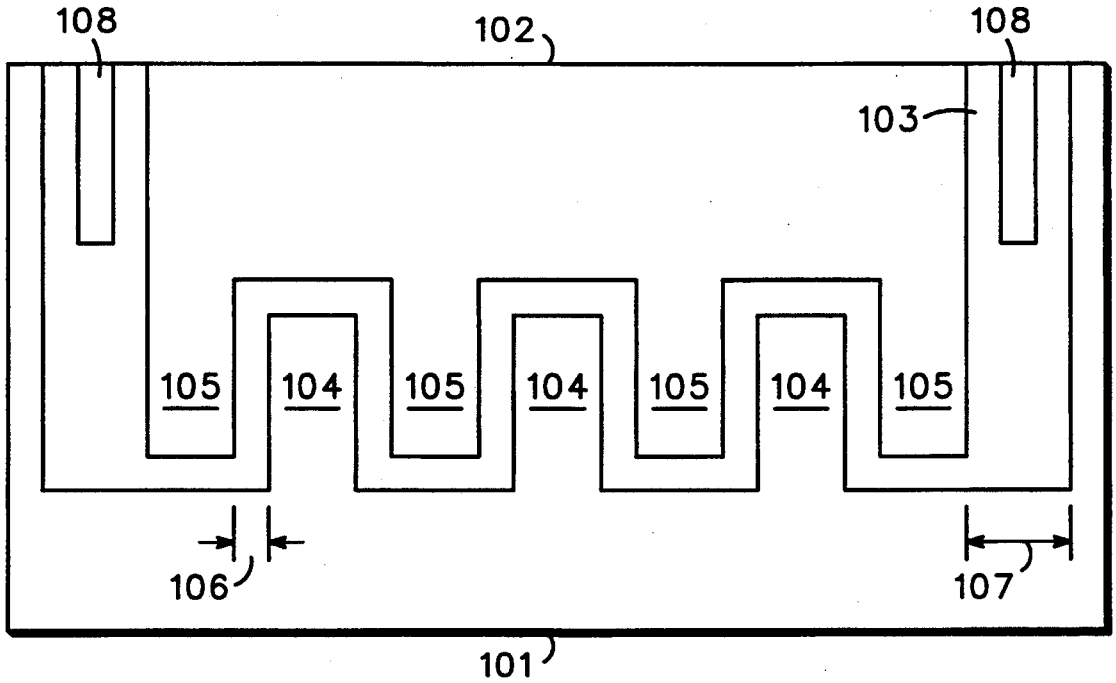
FIG. 1 is a pictorial diagram illustrating a physical layout of a resistor in accordance to the present invention.

The present invention can be more fully described with reference to FIGS. 1–5. FIG. 1 illustrates a thin film resistor 100 that includes a first electrode 101, a second electrode 102, and a resistive material 103 for electrically coupled first and second electrodes 101 and 102.

First and second electrodes 101 and 102 respectively include interdigitated fingers 104 and 105 thereby forming the geometry for resistor 100. The most common material for electrodes 101 and 102 is gold, but other materials such as silver, aluminum and tantalum may be used.

Resistor 100 includes first distance 106 which is a first predetermined distance representing the thickness of resistive material 103 over a first portion of resistor 100. In a preferred embodiment, distance 106 is substantially equal to 0.005 inches. Distance 106 is selected to minimize the distance between electrodes 101 and 102 thereby minimizing the current path between electrodes 101 and 102 and reducing the reactance component of resistor 100. The resistive material 103 with the distance 106 accounts for the major component of the total resistance of resistor 100. Resistive material 103 may be nickel-chromium (nichrome), tantalum nitride and cermets (chromium and silicon monoxide).

Resistor 100 also includes second distance 107 which is a second predetermined distance representing the thickness of resistive material 103 over a second portion of resistor 100. In a preferred embodiment, distance 107 is substantially equal to 0.008 inches. Distance 107 and resistive material 103 account for the remaining component of the total resistance. Further, distance 107 is selected so as to allow sufficient area for laser trimming resistor 100.

The trim cut 108 is the result of a laser trimming operation. Resistive material 103 is vaporized by a laser in an area of resistive material 103 where its thickness is separated by second distance 107 thereby effectively removing a portion of resistive material 103 as denoted by trim cut 108. The removal of the resistive material 103 causes an increase in the resistance of the resistor 100.

In fabricating thin film resistors such as resistor 100, photolithography techniques are used. First, a layer of resistive material is deposited on a substrate. A layer of electrically conductive material is then deposited. Photoresist is now applied and the conductive material is patterned (for example, in the form of the first electrode 101, the second electrode 102, the first distance 106 and the second distance 107) by standard photolithographic techniques. Additional gold is now electroplated to form the final conductor pattern. The photoresist is then removed leaving electroplated conductors on top of a resistive layer. Photoresist is now re-applied and the resistor is patterned (This completes the region of the resistive material 103.) by standard photolithographic techniques. The result is a finished thin-film resistor 100 consisting of an etched resistor between electroplated conductors.

Figure 2:
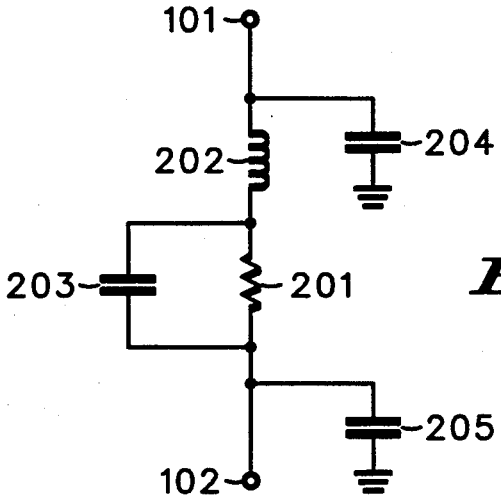
FIG. 2 is a detailed schematic diagram illustrating an equivalent circuit of the resistor of FIG. 1.

FIG. 2 is a detailed schematic diagram illustrating equivalent circuit 200 of the resistor 100. As shown, the equivalent circuit 200 includes resistive, capacitive and inductive elements. Capacitor 204 is coupled between the first electrode 101 and ground. Similarly capacitor 205 is coupled between the second electrode 102 and ground. These capacitors 204 and 205 represent the capacitance to ground of the thin-film resistor. Between the first electrode 101 and the second electrode 102 is a parallel combination of resistor 201 and capacitor 203 which is coupled in series with an inductor 202. Resistor 201 is the DC or low frequency resistance of the thin-film resistor, capacitor 203 represents the fringing capacitance between first electrode 101 and the second electrode 102. The inductor 202 represents the series inductance of the first electrode 101, second electrode 102 and resistive material 103. At DC or very low frequencies, the capacitors 203, 204, and 205 appear as open circuits while the inductor 202 appears as a short circuit, thus leaving the impedance between the first electrode 101 and second electrode 102 to be the resistor 201.

With increasing frequency, these reactive elements result in a complex impedance between the first electrode 101 and second electrode 102. The geometry arrangement of fingers 104 and 105 along with first distance 106 provides a very short current path between the first electrode 101 and the second electrode 102 through the resistive material 103. This reduces the value of the inductive element 202 in the equivalent circuit model of FIG. 2. The short current path minimizes the amount of current near the outer perimeter of the electrodes thus decreasing the value of the capacitors 204 and 205 in the equivalent circuit model of FIG. 2. The reduction of these reactance elements in the equivalent circuit results in a resistor that has an enhanced frequency response, that is to say that the impedance between the first electrode 101 and second electrode 102 appears predominately as a real impedance rather than a complex impedance.

Figure 3:
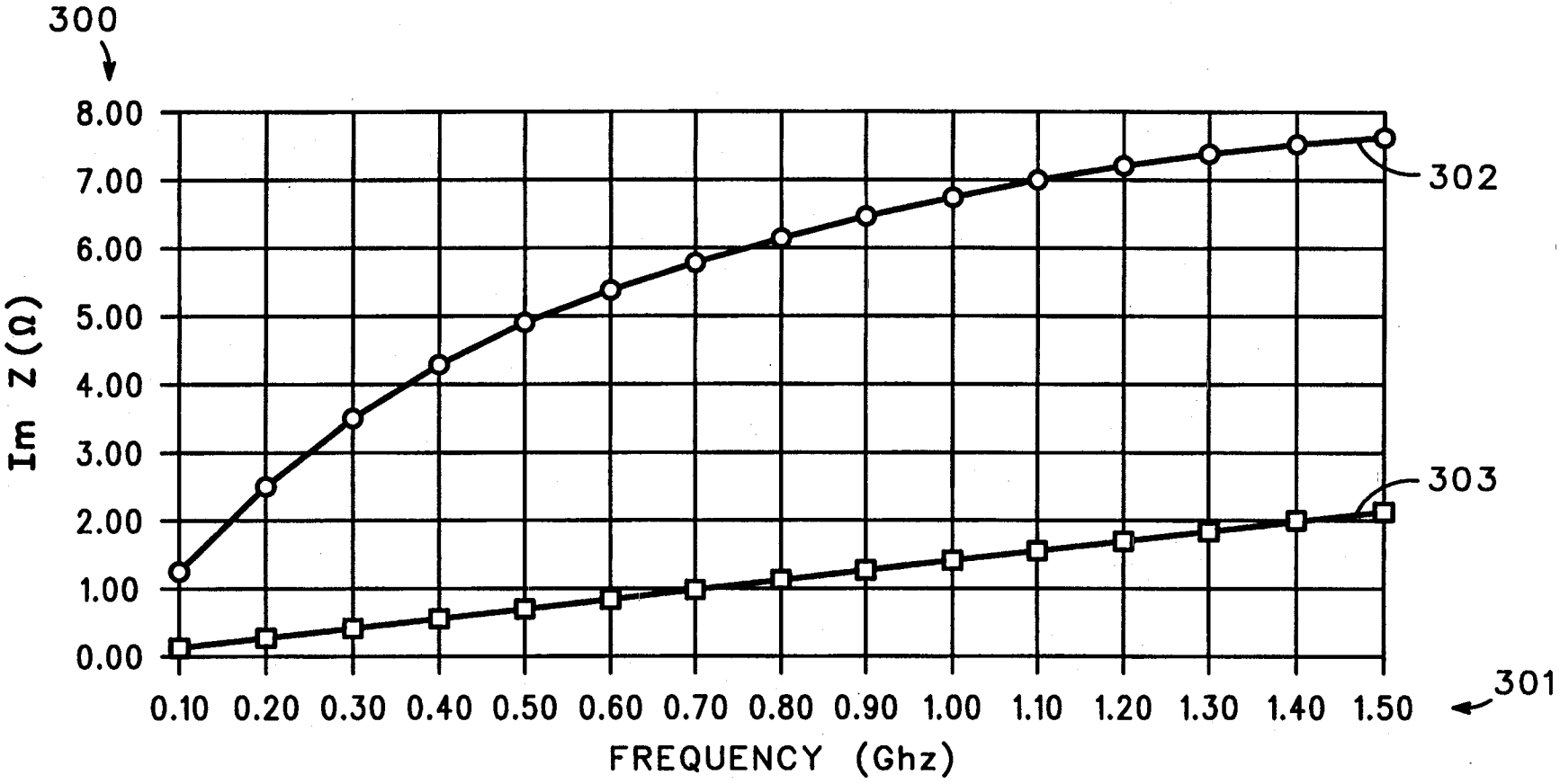
FIGS. 3 and 4 are graphical diagrams illustrating computer simulated response characteristics of the resistor of FIG. 1 in comparison to prior art resistors.
Figure 4:
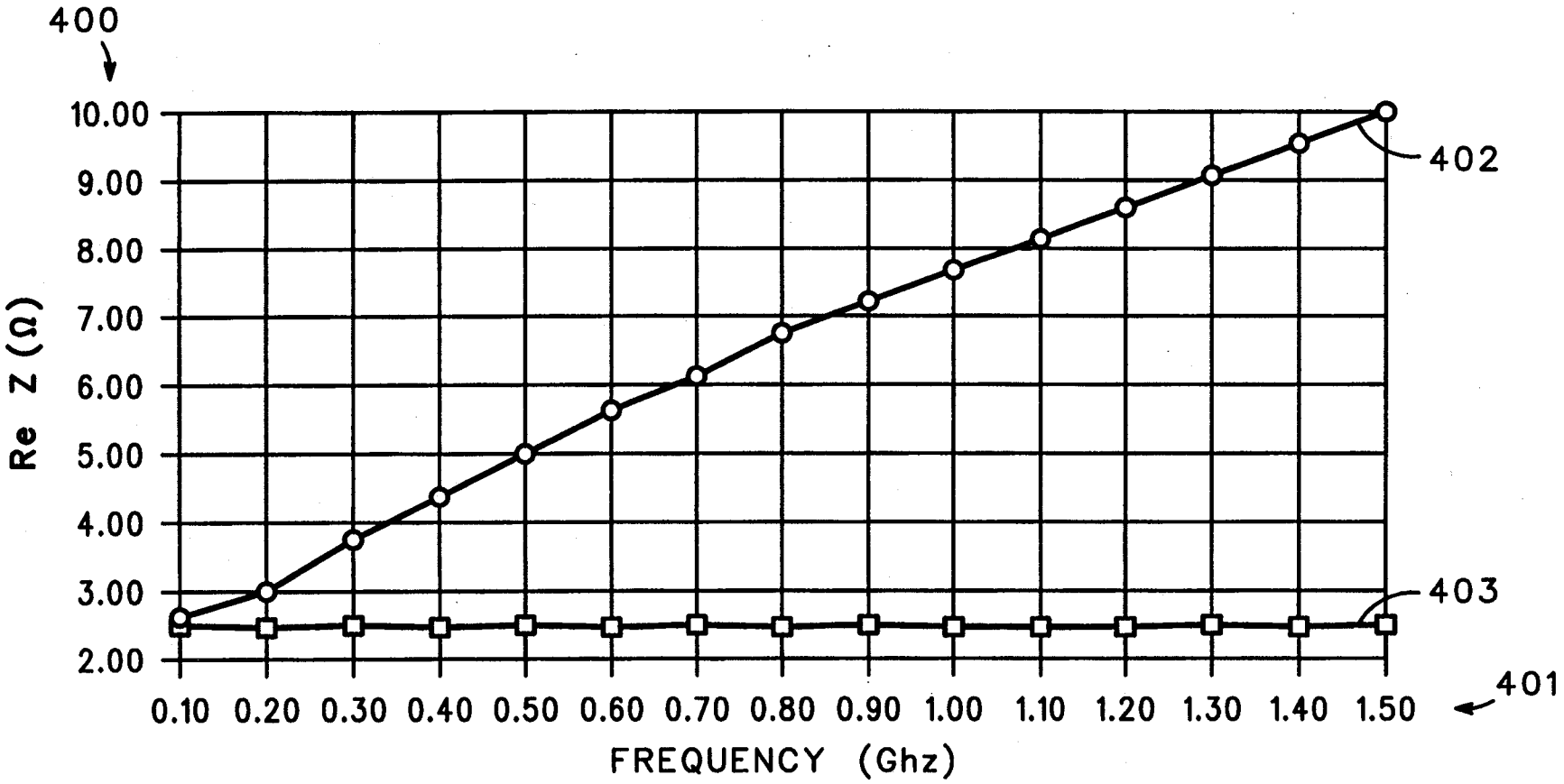

FIGS. 3 and 4 are graphical diagrams illustrating response characteristics of the resistor 100 in comparison to prior art resistors (such as those whose lateral dimensions are long when realizing low value resistances). FIGS. 3 and 4 are based on computer simulations using the physical geometry of resistor 100 as shown in FIG. 1. In particular, the geometries of resistor 100 and a prior art resistor are fed into a High Frequency Structural Simulator (HFSS) software to obtain their respective S-parameters. These S-parameters are then used as inputs to, for example, the Hewlett-Packard Microwave Design Simulator (HPMDS) software to obtain points for the curves of FIGS. 3 and 4. Both HFSS and HPMDS software packages are commercially available.

As stated earlier, the resistor 100 has an improved frequency response. The imaginary part of the impedance between the first electrode 101 and second electrode 102 is substantially smaller than prior art resistors as shown in FIG. 3. The vertical scale 300 of the graph is the imaginary part of the resistor impedance while the horizontal scale 301 of the graph is frequency. The imaginary part of a prior art resistor as represented by curve 302 is substantially higher than that of resistor 100 which is represented by curve 303. Thus, a substantial reduction in the imaginary part of the resistor 100 impedance is observed.

In addition to a lower imaginary component, resistor 100 exhibits a constant real impedance versus frequency as shown in FIG. 4. The vertical scale 400 of the graph is the real part of the resistor impedance while the horizontal scale 401 of the graph is frequency. The real part of a prior art resistor as represented by curve 402 is not constant with frequency and is increasing, while the real part of resistor 100 which is represented by the curve 403 is essentially constant. Thus, the real part of the impedance of resistor 100 is substantially constant with frequency. This, in combination with a substantially lower imaginary part as shown in FIG. 3, results in an improved frequency response compared to prior art resistors.

Figure 5:
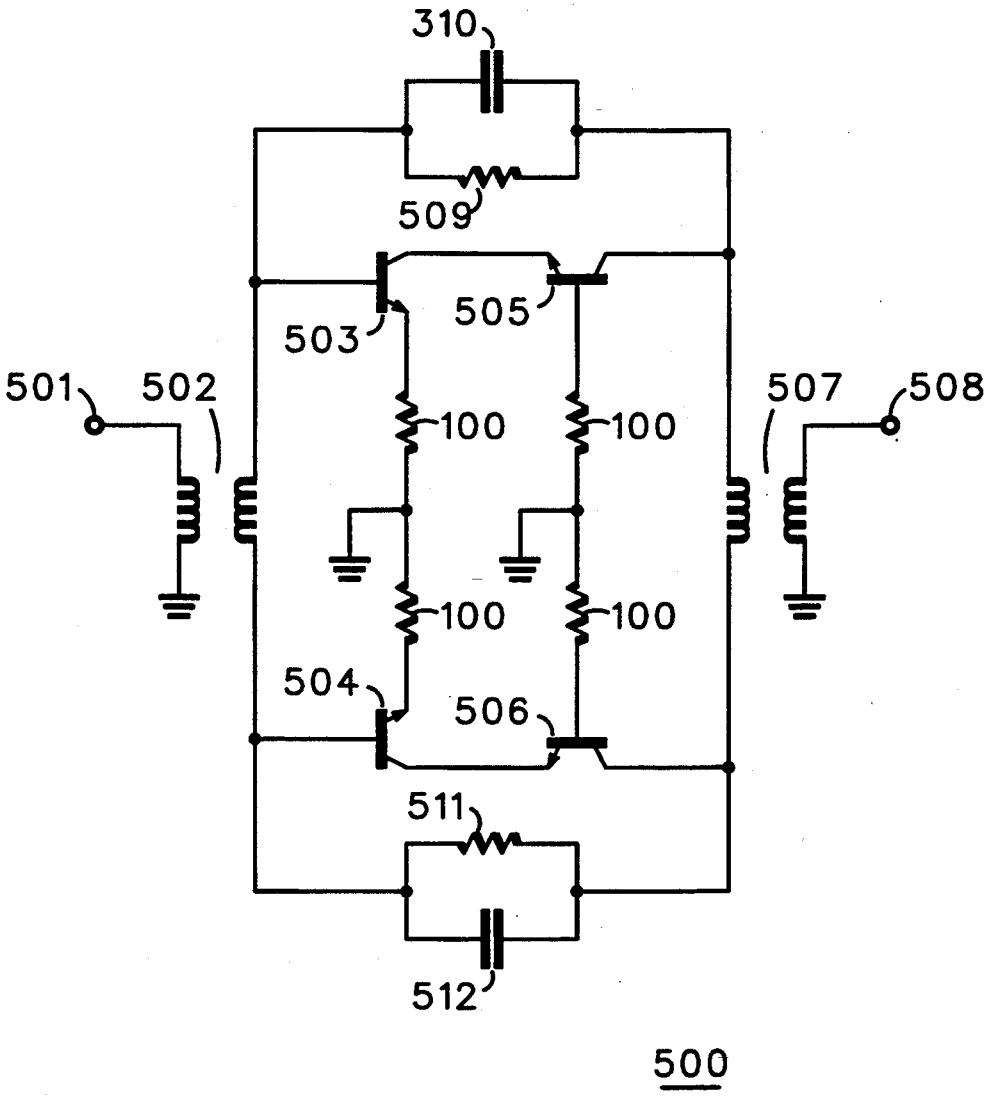
FIG. 5 is a detailed schematic diagram illustrating an RF amplifier utilizing the resistor of FIG. 1.

FIG. 5 is a detailed schematic diagram illustrating amplifier 500 that utilizes resistor 100. The amplifier 500 further includes active devices 503, 504, 505, 506, shunt feedback elements consisting of resistors 509, 511 and capacitors 510, 512, impedance matching transformers 502, 507, a input terminal 501 and a output terminal 508.

The circuit is a balanced amplifier operating in a push-pull configuration. The circuit is often found in broadband amplifier applications such as CATV. The performance of this amplifier (such as gain, input return loss, output return loss, distortion) is directly related to the feedback elements consisting of resistors 100, 509 and 511. The capacitors 510 and 512 influence the slope of the gain response at the higher frequencies. The enhanced frequency response of resistor 100 results in an improved amplifier response since the amplifier response is directly related to the frequency response of the feedback elements.

The present invention provides a method and apparatus for producing a resistor that has enhanced frequency response. With such a method and apparatus, a resistor maintains its desired impedance characteristics versus frequency. The resistor impedance characteristic exhibits a substantially constant real part with an small imaginary part. For example, a real component of the complex impedance varies by less than 10% of its value at 100 megahertz over a frequency range of at least one gigahertz and an imaginary component of the complex impedance varies linearly with frequency over the frequency range of at least one gigahertz. In particular, the real component of the complex impedance varies by less than 2% over a frequency range of at least two hundred megahertz and an imaginary component of the complex impedance varies linearly with frequency over the frequency range of at least two hundred megahertz. Moreover, in feedback amplifier applications, this enhanced frequency response characteristic of the resistor results in a similar improvement in the amplifier frequency response.

While the invention has been described in specific embodiments thereof, it is evident that many alterations, modifications and variations will be apparent to those skilled in the art. Further, it is intended to embrace all such alterations, modifications and variations in the appended claims.

We claim:

1. A resistor which exhibits a complex impedance versus frequency, the resistor comprising:

a substrate:

a resistive material disposed on a portion of the substrate wherein the resistive material has a first portion coupled to a second portion by a third portion;

a first electrode having a plurality of fingers; and a second electrode having a plurality of fingers, wherein the second electrode is resistively coupled to the first electrode via the resistive material and the plurality of fingers of the first electrode are interdigitated with the plurality of fingers of the second electrode, and wherein a first portion of the first electrode is spaced apart from a first portion of the second electrode by a first distance and a second portion of the first electrode is spaced apart from a second portion of the second electrode by a second distance, the second distance being greater than the first distance.

2. The resistor according to claim 1 wherein the first distance is selected to minimize reactance components of the resistor.

3. The resistor according to claim 1, further including a trim cut in at least the first portion of the resistive material, the trim cut for trimming the resistor.

4. The resistor according to claim 3 wherein the second distance is substantially equal to 8 mils and wherein the first distance is substantially equal to 5 mils.

5. The resistor according to claim 1, wherein the resistive material is selected from the group of chrome silicon oxide, nichrome, and tantalum nitride.

6. The resistor according to claim 1 wherein the resistor is a thin film resistor.

7. A method for making a resistor having a complex impedance, the method comprising the steps of:

a) depositing a resistive material on a substrate to produce a deposited resistive material;

b) depositing a first electrode to electrically couple to a first portion of the deposited resistive material, wherein the first electrode includes a first portion comprising a plurality of fingers;

c) depositing a second electrode to electrically couple to a second portion of the deposited resistive material, wherein the second electrode includes a first portion comprising a plurality of fingers, wherein the plurality of fingers of the first electrode are a first distance from the plurality of fingers of the second electrode such that a real component of the complex impedance varies by less than 10% of its value at 100 megahertz over a frequency range of at least one gigahertz and an imaginary component of the complex impedance varies linearly with frequency over the frequency range of at least one gigahertz.

8. The method according to claim 7 further including the step of selecting the first distance to minimize reactance components of the resistor.

9. The method according to claim 7, wherein the steps of depositing first and second electrodes further include forming the first electrode to have a second portion and forming the second electrode to have a second portion, the second portion of the first electrode being a second distance from the second portion of the second electrode.

10. The method according to claim 9 further includes providing the first distance to be substantially equal to 8 mils and providing the second distance to be substantially equal to 5 mils.

11. The method according to claim 7 further includes providing the resistive material to be one of chrome silicon oxide or nichrome.

12. A resistor in an amplifier, the amplifier having a frequency response that is a function of a complex impedance of the resistor, the resistor comprising:

a resistive material disposed on a portion of a substrate, wherein the resistive material has a first portion coupled to a second portion by a third portion, the first portion of the resistive material having a width that is greater than a width of the third portion of the resistive material;

a first electrode having a plurality of fingers; and a second electrode having a plurality of fingers, wherein the second electrode is resistively coupled to the first electrode via the resistive material, wherein the plurality of fingers of the first electrode are interdigitated with the plurality of fingers of the second electrode, and wherein the plurality of fingers of the first electrode is a first distance from the plurality of fingers of the second electrode such that a real component of the complex impedance varies by less than 10% of its value at 100 megahertz over a frequency range of at least one gigahertz and an imaginary component of the complex impedance varies linearly with frequency over the frequency range of at least one gigahertz, thereby maintaining the gain of the amplifier substantially constant.

13. The resistor according to claim 12 further including a second distance between the first and second electrodes for trimming the resistor.

14. The resistor according to claim 13, wherein a portion of the first portion of the resistive material has a trim cut.

15. The resistor according to claim 13 wherein, for values of the resistor within a predetermined range, a layout area of the resistor is substantially reduced.

16. The resistor according to claim 1, wherein the third portion of the resistive material is between the plurality of fingers of the first electrode and the plurality of fingers of the second electrode.

17. The resistor according to claim 1, wherein a real component of the complex impedance varies by less than 10% of its value at 100 megahertz over a frequency range of at least one gigahertz and an imaginary component of the complex impedance varies linearly with frequency over the frequency range of at least one gigahertz.

18. The resistor according to claim 1, wherein a real component of the complex impedance varies by less than 2% over a frequency range of at least two hundred megahertz and an imaginary component of the complex impedance varies linearly with frequency over the frequency range of at least two hundred megahertz.

19. The resistor according to claim 3, further including a trim cut in the second portion of the resistive material.

20. The resistor according to claim 4, wherein the widths of the first and second portions of the resistive material are substantially equal to 8 mils.

21. The resistor according to claim 1, wherein the third portion has a square wave shape.

22. The resistor according to claim 21, wherein a portion of the second portion of the resistive material has a trim cut.

23. The resistor according to claim 15 wherein the second distance is substantially equal to 8 mils and wherein the first distance is substantially equal to 5 mils.

* * * * *

UNITED STATES PATENT AND TRADEMARK OFFICE

CERTIFICATE OF CORRECTION

PATENT NO. : 5,420,562

DATED : May 30, 1995

INVENTOR(S) : Robert S. Kaltenecker

It is certified that error appears in the above-indentified patent and that said Letters Patent is hereby corrected as shown below:

In column 6, line 30, claim 14, delete "13" and insert therefor --12--.

In column 6, line 33, claim 15, delete "13" and insert therefor --12--.

In column 6, line 64, claim 23, delete "15" and insert therefor --13--.

Signed and Sealed this

Third Day of October, 1995

Bruce Lehman

*Attest:*

BRUCE LEHMAN

*Attesting Officer*

*Commissioner of Patents and Trademarks*